United States Patent [19]

Bricker

[11] Patent Number: 4,897,175

[45] Date of Patent: Jan. 30, 1990

[54] PROCESS FOR IMPROVING THE COLOR AND COLOR STABILITY OF A HYDROCARBON FRACTION

[75] Inventor: Jeffery C. Bricker, Buffalo Grove; Bryan L. Benedict, Evanston; Sheila L. Pollostrini, Bloomingdale, all of Ill.

[73] Assignee: UOP, Des Plaines, Ill.

[21] Appl. No.: 237,471

[22] Filed: Aug. 29, 1988

[51] Int. Cl.[4] ..... C10G 17/00; C10G 45/00

[52] U.S. Cl. ..... 208/12; 208/142; 208/143; 208/145; 208/263

[58] Field of Search ..... 208/12, 143, 145, 263

[56] References Cited

U.S. PATENT DOCUMENTS

| | | | |
|---|---|---|---|
| 2,779,711 | 1/1957 | Goretta | 208/143 |
| 2,793,986 | 5/1957 | Lanning | 196/35 |
| 2,880,166 | 3/1959 | Wilson | 208/143 |
| 3,050,459 | 8/1962 | Schuman | 208/97 |
| 3,072,564 | 1/1963 | Stewart, Jr. | 208/143 |
| 3,112,259 | 11/1963 | Crawitz | 208/143 |
| 3,162,597 | 12/1964 | Davis, Jr. et al. | 208/143 |
| 3,172,839 | 3/1965 | Kozlowski | 208/143 |
| 3,189,540 | 6/1965 | Kozlowski | 208/12 |
| 3,281,352 | 10/1966 | Schuman | 208/12 |

*Primary Examiner*—Helane Myers

*Attorney, Agent, or Firm*—Thomas K. McBride; Eugene I. Snyder; Frank S. Molinaro

[57] ABSTRACT

This invention relates to a process for improving the color and color stability of a hydrocarbon fraction. The process involves contacting the hydrocarbon fraction with a selective hydrogenation catalyst in the presence of hydrogen at reaction conditions. This results in the selective hydrogenation of conjugated unsaturates, thereby improving the color and color stability of the hydrocarbon fraction. The process uses small quantities of hydrogen and is run under mild conditions.

8 Claims, No Drawings

PROCESS FOR IMPROVING THE COLOR AND COLOR STABILITY OF A HYDROCARBON FRACTION

BACKGROUND OF THE INVENTION

This invention relates to a process for the improvement of the color and color stability of a hydrocarbon fraction. In one aspect, this invention relates to a catalytic selective hydrogenation treatment of a hydrocarbon fraction to render the hydrocarbon fraction color stable.

The improvement of color stability of a hydrocarbon fraction (and kerosene in particular) is desirable because it increases the marketability of the hydrocarbon fraction. For example, kerosene used as a carrier for insecticides and similar materials should be substantially colorless and color-stable in order to avoid staining materials with which it may come in contact. When kerosene or other hydrocarbon fractions are used as jet fuel, thinners or vehicles for paints or coatings, color stability is also very desirable.

There are several methods known in the art to improve both the color and color stability of hydrocarbon fractions in general and kerosene in particular. For example, a hydrocarbon fraction may be processed through an adsorbent (usually a clay) to remove the color bodies. However, because clays are very expensive, this type of treating process is rarely used. Another method is hydrogenation as shown in U.S. Pat. No. 2,793,986 which discloses treating kerosene at a temperature of 500° to 650° F. at a pressure of 100 to 250 p.s.i. and a hydrogen flow of 1,000 to 5,000 cubic feet per barrel of kerosene treated. The treatment is conducted in the presnece of a molybdenum oxide/silica/alumina catalyst. These conditions are extremely severe and not only hydrogenate the color bodies, but would also hydrogenate olefins, aromatics and nitrogen and sulfur compounds (to ammonia and hydrogen sulfide respectively). This is usually referred to as hydrotreating.

The disadvantages to hydrotreating are that it costs about 50 cents to one dollar per barrel to run, it alters the major components of the fraction, and it consumes large quantities of hydrogen. Therefore, there is a need for a process which would render a hydrocarbon fraction color stable but does not cost as much to operate or consume large quantities of hydrogen.

Applicants have discovered a process that fills this need. Applicants' process is a selective hydrogenation process. Thus, applicants' process uses only about 0.1 to 2 cubic feet of hydrogen per barrel of kerosene versus 1,000 to 5,000 cubic feet per barrel required by the '986 patent. According to the '986 patent, pressures below 100 p.s.i. result in improved color only in the case of untreated kerosenes already having extremely high color. Applicants have found that any type of kerosene can be treated at pressures below 100 psi. The instant invention can be run at a termperature as low as 25° C. whereas the lowest temperature at which the '986 process can be run is 260° C.

Applicants' process also does not alter the major components of the fuel. This is evidenced by the fact that the amount of aromatics present in the hydrocarbon fraction is the same before and after treating. Thus, only the color bodies and color body precursors are being hydrogenated. The instant process represents a significant advance in the art of rendering hydrocarbon fractions color stable.

SUMMARY OF THE INVENTION

This invention relates to a process for improving the color and color stability of a hydrocarbon fraction containing color bodies and color body precursors comprising contacting the hydrocarbon fraction with a selective hydrogenation catalyst in the presence of hydrogen, at reaction conditions and for a time sufficient to hydrogenate the color bodies and color body precursors, thereby providing a color stable hydrocarbon fraction.

Thus, one specific embodiment comprises contacting kerosene with a platinum on carbon catalyst in a batch reactor at a temperature of about 50° C., 13.6 atmospheres of hydrogen, thereby selectively hydrogenating the color body precursors.

This and other objects and embodiments will become more apparent after a more detailed description of the invention.

DETAILED DESCRIPTION OF THE INVENTION

As heretofore stated, this invention relates to a process for improving the color and color stability of a hydrocarbon fraction. The types of hydrocarbon fractions which may be treated using this process generally have a boiling point in the range of about 40° to about 325° C. Specific examples of these fractions are kerosene, straight run gasoline, straight run naphthas, heavy gas oils, jet fuels, diesel fuel, cracked gasoline and lubricating oils.

An essential part of the instant process is to contact the hydrocarbon fraction with a selective hydrogenation catalyst. The selective hydrogenation catalyst may be selected from well known selective hydrogenation catalysts. For example, Group VIII metals of the Periodic Table dispersed on a porous support are known to be good selective hydrogenation catalysts. The Group VIII metals are iron, cobalt, nickel, ruthenium, rhodium, palladium, osmium, iridium and platinum. Group VIII metals which are particularly effective for the instant process are ruthenium, platinum, iron, palladium and nickel.

The porous support on which the desired metal is dispersed may be selected from the group consisting of alumina, silica, carbon, alumina-silicates, synthetic and natural clays and alkaline earth oxides, e.g., CaO, MgO, etc., with carbon being preferred. The porous support should have a surface area of about 3 to about 1200 $m^2/g$ and preferably from about 100 to about 1,000 $m^2/g$ and a pore volume of about 0.1 to about 1.5 cc/g, and preferably from about 0.3 to about 1.0 cc/g. The porous support may be formed in any shape which exposes the metal to the hydrocarbon fraction. Particulate shape is usually used for convenience. In particular, the support may be in the shape of pellets, spheres, extrudates, irregular shaped granules, etc.

The Group VIII metal may be dispersed on the porous support in any manner well known in the art as impregnation with a solution of a Group VIII metal compound. The solution may be an aqueous solution or an organic solvent may be used, with an aqueous solution being preferred. Illustrative of the metal compounds which may be used to disperse the desired metals are chloroplatinic acid, ammonium chloroplatinate, hydroxy disulfite platinum (II) acid, bromoplatinic acid, platinum tetrachloride hydrate, dinitrodiamino platinum, sodium tetranitroplatinate, ruthenium tetrachloride, ruthenium nitrosyl chloride, hexachlororuthenate, hexaammineruthenium chloride, iron chloride, iron nitrate, palladium sulfate, palladium acetate, chloropalladic acid, palladium chloride, nickel chloride, nickel nitrate, nickel acetate, nickel sulfate, cobalt chloride, cobalt nitrate, cobalt acetate, rhodium trichloride, hexaaminerhodium chloride, rhodium carbonylchloride, rhodium nitrate, hexachloroiridate (IV) acid, hexachloroiridate (III) acid, ammonium hexachloroiridate (III), ammonium aquohexachloroiridate (IV), tetraamminedichloroiridate (III) chloride, and osmium trichloride.

The metal compound may be impregnated onto the support by techniques well known in the art such as dipping the support in a solution of the metal compound or spraying the solution onto the support. One preferred method of preparation involves the use of a steam jacketed rotary dryer. The support is immersed in the impregnating solution contained in the dryer and the support is tumbled therein by the rotating motion of the dryer. Evaporation of the solution in contact with the tumbling support is expedited by applying steam to the dryer jacket. Regardless of how the impregnation is carried out, the impregnated support is dried and then heated at a temperature of about 200 to about 450° C. in a nitrogen-10% steam atmosphere for a period of time of about 1 to about 3 hours.

The amount of metal dispersed on the support may vary considerably but generally an amount from about 0.01 to about 20.0 weight percent of the support is adequate to effect the treatment. Specifically when the desired metal is platinum or ruthenium, the amount present is conveniently selected to be from about 0.1 to about 5 weight percent.

The hydrocarbon fraction is contacted with the selective hydrogenation catalyst in the presence of hydrogen. The hydrogen reacts with some of the unsaturated hydrocarbons (unsaturates) present in the hydrocarbon fraction. It is believed that unsaturates (especially conjugated ones) undergo reactions (oxidation) to form color bodies that absorb energy in the visible range of the light spectrum. Hydrogenation of unsaturates prevents the formation of color bodies. For example, phenols can be oxidized to quinones which are highly colored species. By hydrogenating phenols to cyclohexanols, the formation of quinones is prevented. Additionally, the color bodies themselves are hydrogenated using the instant process, thereby improving the color quality of the hydrocarbon fraction. Quinones can thus be hydrogenated to a less conjugated system with an absorption wavelength at lower energy, i.e., outside the visible range. Therefore, the instant process accomplishes two objectives: (1) it eliminates existing color bodies, thereby instantly improving the color quality of the hydrocarbon fraction and (2) it eliminates color body precursors, thereby improving the color stability of the hydrocarbon fraction.

It appears that the instant process hydrogenates highly conjugated unsaturates instead of olefins because there is only a slight decrease in the bromine number after hydrogenation. As will be shown in more detail later, the instant process hydrogenates very little, if any, aromatic components while hydrogenating highly conjugated unsaturated components. Thus, the instant process selectively hydrogenates color bodies and color body precursors without affecting the other components of the hydrocarbon fraction.

The conditions under which the selective hydrogenation takes place are as follows. First, it is necessary to contact the hydrocarbon fraction with the catalyst in the presence of hydrogen at elevated temperature. For convenience, the temperature range may be chosen to be from about 25° to about 250° C. and preferably from about 35° to about 200° C. The process may be carried out at atmospheric pressure although greater than atmospheric pressure is preferred. Thus, a pressure in the range of about 1 to about 15 atmospheres may be used with pressures of 1 to about 10 atmospheres being preferred. Finally, the amount of hydrogen present by vary considerably, but usually the amount is selected to be from about 0.1 to about 3 mole percent based on the total hydrocarbon fraction.

The process may be operated either in a continuous mode or in a batch mode. If a continuous mode is used a liquid hourly space velocity between about 0.1 and about 25 $hr^{-1}$ should be used to provide sufficient time for the hydrogen and unsaturated hydrocarbons to react. If a batch process is used, the hydrocarbon fraction, catalyst and hydrogen should be in contacat for a time from about 0.1 to about 25 hrs.

The process described above may be employed in several places in the overall process of refining crude oil. Specifically, in th case of kerosene, the instant process may be placed directly after the crude fractionation column or upstream of the sweetening unit or downstream of the hydrocarbon sweetening unit.

It should be emphasized that the instant process is run with the hydrocarbon fraction substantially in the liquid phase. Thus, only enough pressure is applied to dissolve the hydrogen into the hydrocarbon fraction and to maintain the hydrocarbon fraction in the liquid phase. This is in contrast to a conventional hydrotreating process where the hydrogen is substantially in the gas phase.

As will be shown in greater detail in the examples that follow, a hydrocarbon fraction treated according to the instant process shows very little deterioration in color stability during an accelerated test, whereas an untreated hydrocarbon fraction deteriorates substantially (within a few hours) during the same test. This increase in color stability was obtained without an appreciable loss in the amount of aromatics present in the hydrocarbon fraction.

The following examples are presented in order to more fully illustrate the advantages to be derived from the instant invention. It is to be understood that the examples are by way of illustration only and are not intended as an undue limitation on the broad scope of the invention as set forth in the appended claims.

EXAMPLE I

A selective hydrogenation catalyst was prepared by the following method. Into a rotary evaporator there were placed 50 grams of a Norit PKDA carbon support. This support was in the shape of granules of size between 35 to 100 mesh (Tyler screen size) and had a surface area of 700 $m^2/g$. To this support there were added 20 mL of an aqueous solution containing 0.05 g of chloroplatinic acid (2.45 weight percent Pt.).

The impregnated support was first rolled in the rotary evaporator for 15 minutes. After this time the evaporator was heated with steam for about 2 hours. Next the impregnated carbon support was dried in an oven for about 2 hours and then heated to 400° C. under a nitrogen atmosphere, held there for 1 hour in the presence of 10% steam/nitrogen and for 30 minutes in the absence of steam, then cooled down to room temperature in nitrogen.

This catalyst was analyzed and found to contain 1.21% platinum. This catalyst was designated catalyst A.

EXAMPLE II

Another selective hydrogenation catalyst was prepared as in Example I with the following modificati0ns. A gamma alumina was used as the support instead of the carbon support and ruthenium nitrosyl chloride was used instead of the chloroplatinic acid.

This catalyst was calculated to contain 1% ruthenium and was designated catalyst B.

EXAMPLE III

A sample of kerosene was selectively hydrogenated according to the following procedure. In an autoclave there was placed 61 mL of kerosene and 4.75 g of catalyst B. The autoclave was heated to 190° C. and hydrogen was added to give a pressure of 200 psig or 13.7 atm. (This corresponds to 0.28 moles of hydrogen). These conditions were maintained for 24 hours.

Table 1 presents the analyses of the kerosene before and after hydrogenation.

TABLE 1

Comparison of Kerosene Components Before and After Hydrogenation

| Component | Untreated Kerosene | Hydrogenated Kerosene |
|---|---|---|
| Total sulfur (wt. %) | 0.26 | 0.16 |
| Total Nitrogen (ppm) | 1.5 | 0.1 |
| Carbonyls (ug/l) | 14 | 8 |
| Phenols (ppm) | 235 | 30 |
| Bromine # (gBr/100 g) | 5.8 | 3.8 |
| FIA Volume (%) | | |
| Aromatic | 21.8 | 21.7 |
| Paraffin & Naphthenes | 78.2 | 78.3 |

The data in Table 1 show that only 0.1% of the aromatics were hydrogenated and there was only a small decrease in the bromine number, indicating that only a small fraction of the olefins were hydrogenated.

EXAMPLE IV

A sample of kerosene was hydrogenated using catalyst A under the following conditions. In an autoclave there were placed 245 mL of kerosene and 20 g of catalyst A. The autoclave was heated to 50° C. and hydrogen was added to give a pressure of 200 psig or 13.7 atm. (This corresponds to 0.195 moles of hydrogen.) These conditions were maintained for 24 hours.

EXAMPLE V

Samples of kerosene that were untreated (sample C) and treated according to Example III (sample D) were evaluated for color stability using the following procedure. The samples were individually heated to 99° C. under an air atmosphere. Periodically the APHA color was determined according to ASTM method D1209. This test method is similar to that recorded in the Standard Methods for the Examination of Water and Waste Water of the American Public Health Association and is often referred to as "APHA" color. In this method the absorbance of the kerosene at 465 nm was measured with a spectrophotometer. this absorbance is proportional to color formation in the kerosene.

Heating the sample to 99° C. greatly accelerates the formation of color bodies. For example, an untreated sample heated at 50° C. for 10 hours has an APHA of 100, whereas one heated at 99° C. for 10 hours has an APHA of 200. After heating at 50° and 99° C. for 40 hours the APHA color was 100 and 470 respectively. Therefore, conducting the tests at 99° C. allowed us to determine color stability in a relatively short time.

The results of this test are presented in Table 2.

TABLE 2

Color Stability of Untreated and Hydrogenated Kerosene

| | APHA COLOR | | |
|---|---|---|---|
| Time (Hours) | Sample C Untreated | Sample D Hydrogenated | Sample E Hydrogenated |
| 0 | 75 | — | 15 |
| 10 | 195 | 5 | 11 |
| 20 | 333 | 35 | 10 |

The data clearly show the decrease in the APHA color obtained after hydrogenation and that the color of the hydrogenated sample has not deteriorated substantially after 20 hours at 99° C. In fact the APHA color of the hydrogenated sample after 20 hours of testing is considerably lower than the initial APHA color of the untreated sample (sample C). Therefore, selective hydrogenation according to the instant invention is very effective at improving the color ad color stability of a hydrocarbon fraction.

EXAMPLES VI

After sample C was tested as described in Example V for 20 hours, it was hydrogenated according to the procedure of Example III, i.e., using a ruthenium on alumina catalyst and at 190° C. This sample was designated sample E. Sample E was evaluated for its initial color and color stability according to the procedure in Example V. The results of this evaluation are presented in Table 2.

The data in Table 2 shows that after hydrogenation the APHA color decreased from 333 to 15. Further, the color stability of this hydrogenated sample was virtually unchanged after being exposed to a temperature of 99° C. in air for 20 hours. Therefore, the instant process is capable of both hydrogenating color bodies present in the kerosene and hydrogenating color body precursors.

EXAMPLE VII

A sample of untreated kerosene (sample C) and a sample of kerosene treated according to Example IV (sample F) were evaluated according to the procedure of Example V. The results of these evaluations are presented in Table 3.

TABLE 3

Color Stability of Untreated and Hydrogenated Kerosene

| | APHA COLOR | | |
|---|---|---|---|
| Time (Hours) | Sample C (Untreated) | Sample F (Hydrogenated) | Sample G (Blank Carbon) |
| 0 | 75 | 15 | 76 |
| 10 | 195 | 38 | 177 |
| 20 | 333 | 55 | 232 |

The results presented in Table 3 are similar to the results in Table 2. That is, a kerosene sample hydrogenated using a platinum on carbon catalyst has a lower APHA color and although its color does increase after 20 hours at 99° C. in air, the color is still below the initial APHA color of the untreated kerosene. The color stability of the kerosene has been improved significantly.

EXAMPLE VIII

A sample of kerosene was treated according to Example IV using a sample of carbon fines that did not contain platinum. The treated sample (Sample G) was then evaluated by the method described in Example V. The results indicate little improvement in color reduction or color stability for the kerosene treated with carbon supports not containing a Group VIII metal. Therefore, the results recorded in Table 3 illustrate that the color stability obtained in Sample F is not due merely to adsorption of the color bodies or color body precursors onto the carbon.

EXAMPLES IX

A reactor was set up to continuously treat kerosene as follows. Kerosene (same as Example III) and hydrogen were fed into a feed charger. The hydrogen pressure in the feed charger was 35 psig which allowed part of the hydrogen (about 0.1 mole percent of the kerosene feed) to dissolve in the kerosene. The kerosene containing hydrogen was now fed into a reactor (under 100 psig pressure) which contained a catalyst bed of 25 cc. The reactor was heated to 40° C. The catalyst consisted of 1% Pt (calculated) on a carbon support and was prepared as in Example I. Kerosene was flowed over the catalyst bed at a liquid hourly space velocity (LHSV) of 1.

Kerosene was treated at the above conditions for 25 hours. Periodically samples were removed and analyzed for APHA color. The results of these analyses are presented in Table IV.

TABLE 4

Color Improvement of Kerosene Using a Continuous Process

| APHA | Time on Stream (Hrs) |
|---|---|
| 76 | 0 |
| 22 | 5 |
| 20 | 12 |
| 25 | 19 |
| 30 | 24 |

The kerosene was also analyzed for aromatic, paraffin and naphthene content with virtually no difference observed between the untreated and treated kerosenes.

The data presented in Table IV shows that a selective hydrogenation catalyst of the instant invention can be used in a fixed bed (continuous hydrocarbon flow) mode to improve the color of the kerosene. Further, very little deterioration is observed after 25 hours of operation. In fact, kerosene was processed through the above reactor for a total of 130 hours (at various LHSV and pressures, with the last 20 hours at the conditions described above) and the APHA at the end of 130 hours was 29 indicating that the instant catalyst is very stable and effective at improving the color of a hydrocarbon fraction.

Thus, having described the invention in detail, it will be understood by those skilled in the art that certain variations and modifications may be made without departing from the spirit and scope of the invention as defined herein and in the appended claims.

We claim as our invention:

1. A process for improving the color and color stability of a hydrocarbon fraction containing color bodies and color body precursors comprising contacting the hydrocarbon fraction with a selective hydrogenation catalyst in the presence of hydrogen, the hydrogen dissolved in the hydrocarbon fraction and present in a concentration of about 0.1 to about 3 mole percent based on the total hydrocarbon fraction, at a temperature of about 25° to about 250° C. and a pressure of about 1 to about 15 atmospheres to hydrogenate the color bodies and color body precursors without substantially hydrogenating any olefins and aromatic compounds contained in the hydrocarbon fraction, thereby providing a color stable hydrocarbon fraction.

2. The process of claim 1 where the selective hydrogenation catalyst comprises a Group VIII metal dispersed on a porous support selected from the group consisting of alumina, silica, carbon, alumina-silicates, natural and synthetic clays and alkaline earth oxides.

3. The process of claim 2 where the Group VIII metal is platinum and is present in a concentration of about 0.1 to about 5 weight percent of the support.

4. The process of claim 2 where the Group VIII metal is ruthenium and is present in a concentration of about 0.1 to about 5 weight percent of the support.

5. The process of claim 2 where the support is carbon.

6. The process of claim 2 where the support is alumina.

7. The process of claim 1 wherein the process is operted in a continuous mode at a liquid hourly space velocity of about 0.1 to about 25 $hr^{-1}$.

8. The process of claim 1 wherein the process is operated in a batch mode and the contact time is from about 0.1 to about 25 hours.

* * * * *